US005107907A

United States Patent [19]

Marchadour

[11] Patent Number: 5,107,907

[45] Date of Patent: Apr. 28, 1992

[54] TWO-STAGE PRODUCT FILLING APPARATUS

[75] Inventor: Jean-Charles Marchadour, Salt Lake City, Utah

[73] Assignee: U.S.A., Inc. Hema, Sandy, Utah

[21] Appl. No.: 572,673

[22] Filed: Aug. 24, 1990

[51] Int. Cl.[5] ..... B65B 3/12; B67C 3/26

[52] U.S. Cl. ..... 141/104; 141/9; 141/146; 141/147; 141/258; 222/145

[58] Field of Search ..... 141/9, 100, 103, 104, 141/105, 146, 147, 152, 258, 259, 260; 222/135, 137, 145, 380

[56] References Cited

U.S. PATENT DOCUMENTS

| | | | |
|---|---|---|---|
| 2,356,176 | 8/1944 | Pechy | 141/147 |
| 2,711,277 | 6/1955 | Riza | 141/105 |
| 2,807,467 | 4/1974 | Tascher et al. | 141/375 |
| 3,626,997 | 12/1971 | Whitaker et al. | 141/258 |
| 3,850,345 | 11/1974 | Merritt | 222/380 X |
| 3,851,801 | 12/1974 | Roth | 222/380 X |
| 4,913,202 | 4/1990 | Miller et al. | 141/259 X |

*Primary Examiner*—William A. Cuchlinski, Jr.
*Assistant Examiner*—G. Bradley Bennett
*Attorney, Agent, or Firm*—Thorpe North & Western

[57] ABSTRACT

A two-stage apparatus for measuring quantities of constituents of a product for canning includes a quantity measuring chamber which is substantially vertical and mounted on a support which rotates about an axis. The chamber comprises a tubular enclosure inside which slides a first piston. A lower part of the chamber is connected by supply conduits to a respective one of a pair of tanks, each of which is for holding a different one of the constituent products. The chamber is also connected by a delivery conduit to a filling nozzle, in which slides a secondary piston. A control valve selectively opens and closes the passages through the supply conduits to the measuring chamber in a predetermined order, and for a predetermined period of time to thereby control the relative quantities of the constituents supplied to the chamber. The control valve is adjustable to vary the ratios of constituents introduced into the chamber. The valve also selectively opens the passage through the delivery conduit to allow the first piston to push the product from the chamber into the filling nozzle. The secondary piston may then push the product out of the filling nozzle into a can.

10 Claims, 6 Drawing Sheets

TWO-STAGE PRODUCT FILLING APPARATUS

BACKGROUND OF THE INVENTION

1) Field of the Invention

This invention relates to apparatus for measuring volumes of material for filling cans or other containers. Most specifically, this invention relates to measuring apparatus for measuring volumes of two materials, such as semi-solid and liquid materials, for mixing together to fill containers.

2) Prior Art

The canning of semi-liquid, pasty or heterogeneous products such as jam containing lumps of fruit, animal foods with large lumps of meat, or foods for human consumption with lumps of meat or vegetables raises problems as to the control of quantity. Some of the machines known in the prior art utilize a plurality of measuring chambers mounted on a rotary support, each of said chambers including a cylinder housing a piston to receive and then discharge product. The chambers are generally arranged vertically around a circumference of the rotary support. In this configuration, an upward stroke of the piston sucks product from a tank through a supply conduit into the cylinder, with the tank generally being located in a central area of the rotary support. A downward stroke of the piston delivers the product from the cylinder into a delivery nozzle which includes a second piston to force the product therefrom into a can. A valve, located in the chamber, selectively controls the opening or closing of passages between the chamber and the tank and delivery nozzle. See, for example, U.S. Pat. No. 4,466,557.

Accurate measurement of the quantity of product delivered by the apparatus is dependent upon a great number of factors. In the past, canning of a product which comprises a liquid and a solid phase has been accomplished generally in one of two ways. A first way has been to use two separate pieces of equipment for filling a can with product. In particular, a first piece of equipment is used to fill the can partially with the more solid, viscous product, and then a second machine adds the liquid product thereto before the can is sealed. This method of canning has proved to be less than satisfactory in that two pieces of equipment or machines are required to complete a single dose for each can.

A second prior art approach involves mixing the solid viscous product with the liquid product in the tank of a single apparatus and then discharging the mixture into cans. This method has also proven to be less than satisfactory in that the more solid parts of the product tend to settle to the bottom of the tank so that the first cans filled tend to have more solid product packed therein, while the cans filled later in the process tend to contain more liquid.

OBJECTS AND SUMMARY OF THE INVENTION

It is an object of the present invention to provide a system for overcoming the aforesaid disadvantages by utilizing a single apparatus capable of a two-stage measurement of solid and liquid portions of a product to be canned.

It is further an object of the present invention to provide a two-stage apparatus for canning a two-constituent product which allows for adjustment of the relative proportion of the two constituents making up the final product.

It is further an object of the present invention to provide a two-stage filling apparatus which will significantly mix liquid and solid portions of a product just prior to the measured dose of product being placed in the can.

These and other objects of the present invention are realized in an improvement in apparatus for controlling the quantity and relative proportions of constituents of a product for canning. The apparatus includes a quantity measuring chamber which is substantially vertical and mounted on a support. The chamber itself comprises a tubular enclosure having its lower part connected, by a pair of supply conduits, to a pair of tanks containing a first constituent (such as a liquid product), and a second constituent (such as a solid product), respectively. The lower part of the tubular enclosure is also connected by a delivery conduit to a vertical cylindrical filling nozzle. A first piston is slidably disposed in the tubular enclosure and a second piston is slidably disposed in the vertical cylindrical filling nozzle. The delivery conduit opens into the vertical cylindrical filling nozzle through a lateral opening. A control valve is located in the chamber to open and close the supply conduits and delivery conduit in predetermined succession for allowing filling of the chamber with the first and second constituents and delivery of the combination of the constituents into the filling nozzle.

In accordance with one aspect of the invention, the support is formed in a circular configuration, as is the control valve in the chamber. The control valve is caused to rotate by a cam and follower system, with the cam being located on the circular support, and the follower being formed as part of the control valve. The cam can be adjusted as to its location on the circular support to thereby control the movement of the control valve from a first stage, in which the first constituent is drawn into the chamber, to a second stage, in which the second constituent is drawn into the chamber. Such adjustment directly controls the relative proportion of constituents of a product which comprises a complete dose to be delivered to the filling nozzle.

BRIEF DESCRIPTION OF THE DRAWINGS

The invention will be more readily understood on reading the following description with reference to the accompanying drawings, like numerals in each drawing being used to represent like elements, in which.

DETAILED DESCRIPTION OF THE INVENTION

Figure 1:
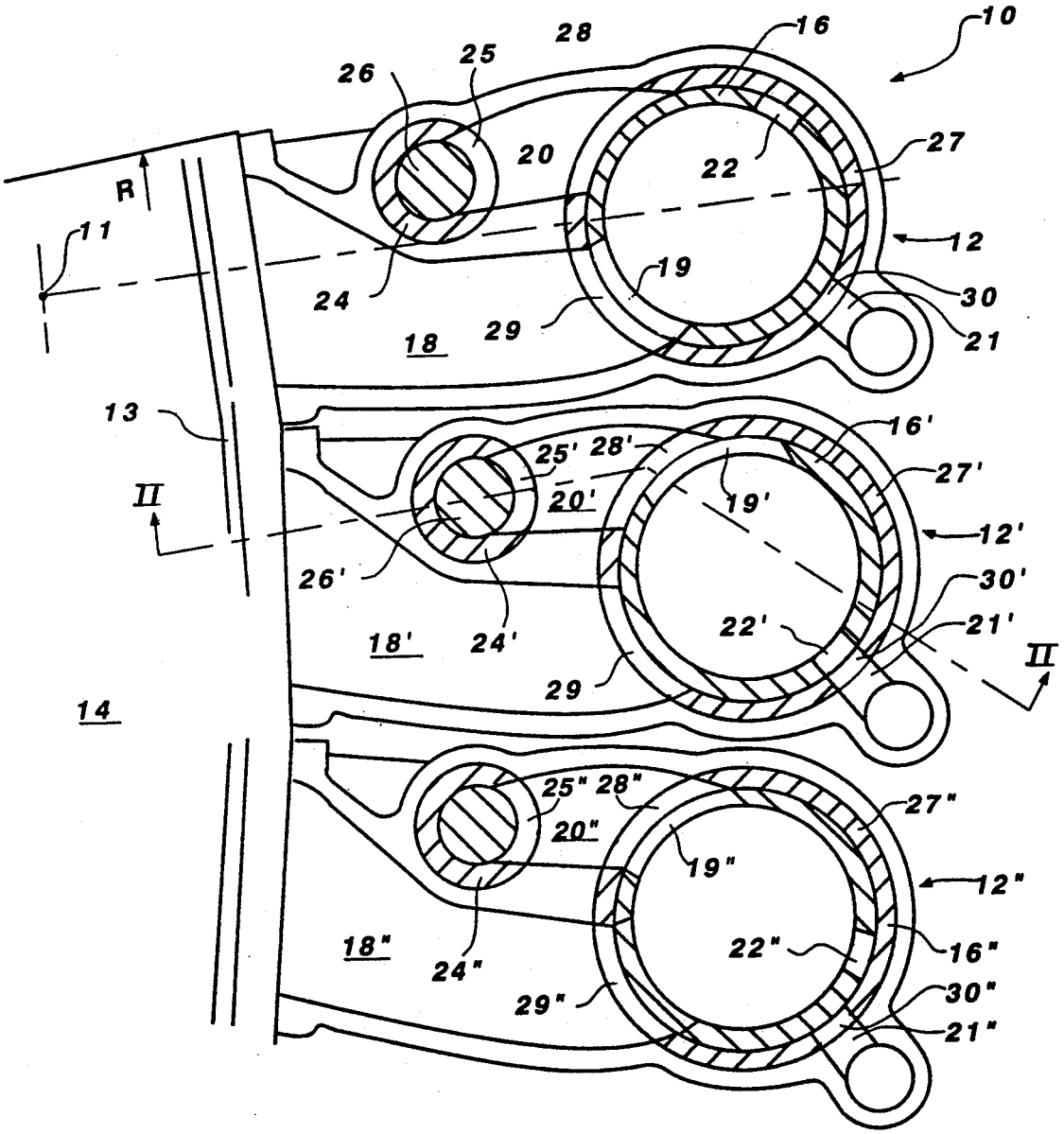
FIG. 1 is a partial, top cross-sectional view of measuring apparatus embodying the principles of the present invention.
Figure 2:
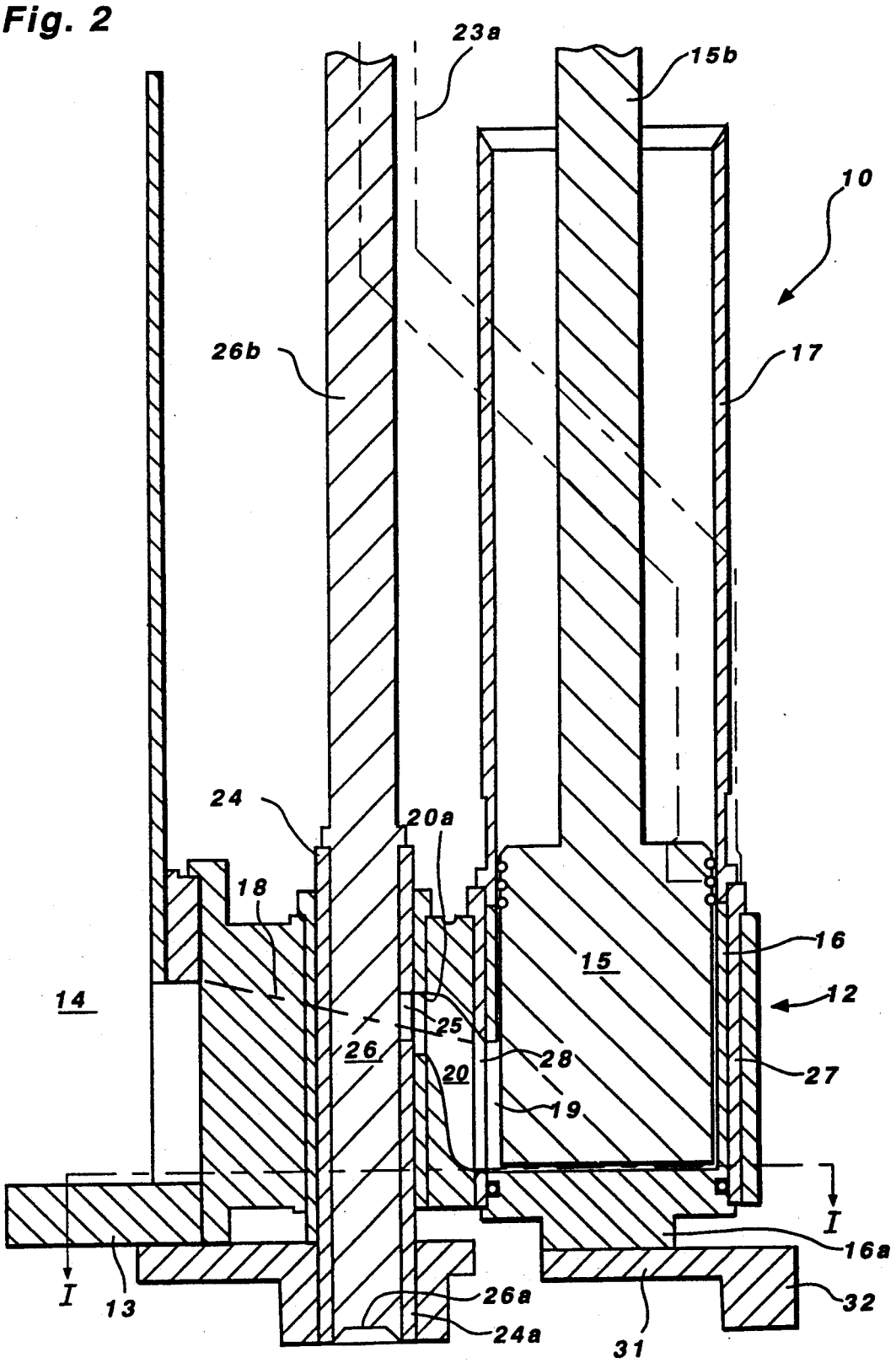
FIG. 2 is a cross-sectional view of part of the apparatus of FIG. 1 taken along lines II—II.

Referring first to FIGS. 1 and 2, canning apparatus 10 of the present invention includes a circular support 13 disposed to rotate (under power of an electrical, hydraulic or like motor, not shown) about a vertical axis 11, a plurality of quantity measuring chamber defining structures 12 which are oriented generally vertically and are integrally attached to the circular support, and a viscous or solid material supply tank 14. The quantity measuring chambers 12 are generally vertically mounted on the periphery of the circular support 13 such that the central axis 11 thereof is generally parallel to the axes of the chambers 12.

Each chamber 12 is formed essentially into a tubular enclosure which contains a piston 15 (FIG. 2) which is operably mounted to slide longitudinally in the enclosure when actuated by a control mechanism in a manner to be described hereinafter. Each chamber 12 (FIG. 2) includes a control valve 16 which is of generally hollow cylindrical shape and which extends from an upper portion 17 of the measuring chamber 12 to form a continuous elongated chamber opening of uniform diameter. The control valve 16 includes a bottom section 16*a* which effectively closes off the end of the elongated tubular interior of the chamber 12. The control valve 16 communicates with a viscous or solid material supply conduit 18 through a valve opening 19, and alternatively with delivery conduit 20. Also, control valve 16 can communicate with liquid material supply conduit 21 through valve opening 22. The openings 19 and 22 in the control valve 16 allow supplying and delivering viscous and liquid materials into and out of the measuring chamber 12. The viscous material supply conduit 18 allows for material flow from the viscous material supply tank 14 to the measuring chamber 12. Likewise, the liquid material supply conduit 21 is in fluid flow connection with a liquid material supply tank 23 (shown in FIG. 3) via a supply line 23*a*, and with the measuring chamber 12.

Delivery conduit 20 allows measured product to pass from measuring chamber 12 therethrough into a vertical, cylindrical filling nozzle 24 and out through a filling nozzle opening 25. Under the lower end of the filling nozzle 24, a can (not shown) would be placed for filling. A secondary piston 26 is mounted for sliding in the filling nozzle 24 between two positions, a lower position (shown in FIG. 2), and an upper position in which the lower end of the piston face 26*a* is just level with the upper edge of the filling nozzle opening 25.

Valve opening 19 of control valve 16 is aligned with either the viscous material supply conduit 18 or the delivery conduit 20. The valve opening 22 is either aligned with liquid material conduit 21 or is sealed off from fluid flow therethrough by a chamber skirt 27. Since the chamber skirt 27 does not rotate relative to the chamber 12, openings 28, 29 and 30 in the chamber skirt remain constantly aligned with conduits 20, 18 and 21 respectively.

The control valve 16 is rotated to its proper orientation in the filling and delivery stages of the apparatus 10 during operation by a lever 31 (FIG. 2) which is provided with a cam follower 32 operable to cooperate with fixed and adjustable camming units (identified at 33, 34 and 35 in FIG. 4) in a manner to be described hereafter.

Figure 3:
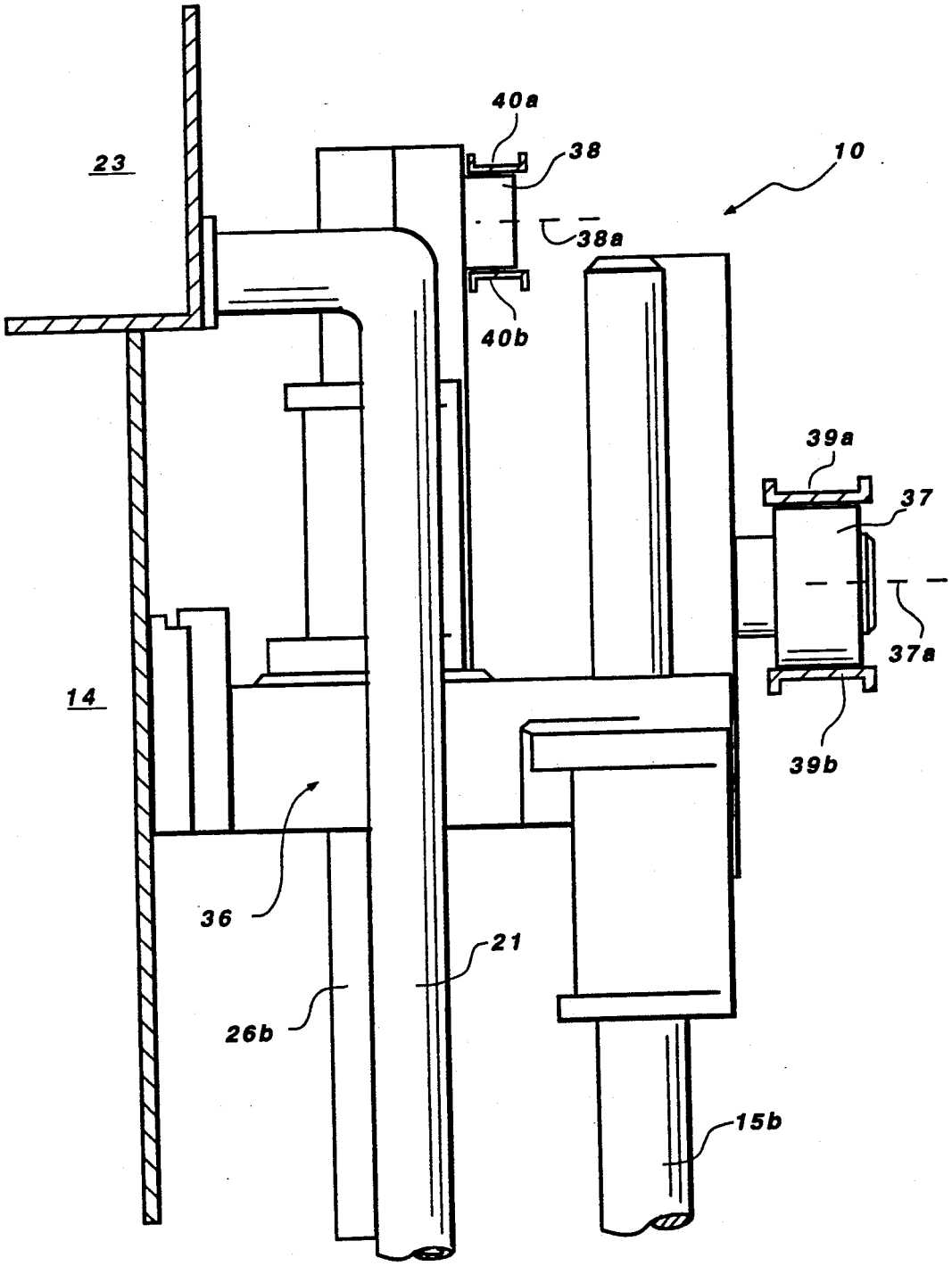
FIG. 3 is a partial side view showing the control of the pistons of the apparatus according to the principles of the present invention.

FIG. 3 diagrammatically illustrates the control mechanism for the chamber piston 15 and nozzle piston 26. A nozzle piston rod 26*b* and a chamber piston rod 15*b* are slidably mounted in a support bracket 36 which is integrally mounted with the viscous material supply tank 14 and rotates therewith. The rods 15*b* and 26*b* are provided with laterally mounted rollers 37 and 38 respectively, which rotate about axes 37*a* and 38*a* respectively. The rollers 37 and 38 are operable to roll along pathways formed by runners 39*a* and 39*b*, and 40*a* and 40*b* respectively. The runners 39*a* and 39*b*, and 40*a* and 40*b* are secured to a supporting structure forming a part of a fixed frame (not shown) of apparatus 10. The running paths 39 and 40 constitute guides for rollers 37 and 38 and control the upward and downward strokes of piston 15 and 26 through suitable slopes imparted to them during movement of the pistons 15 and 26 about axis 11 of the apparatus 10. As is readily evident, runners 39*a* and 40*a* control the downward movement of the pistons, while rollers 39*b* and 40*b* control their upward movement.

The runners 39*a* and 39*b*, and 40*a* and 40*b* need only be given slopes, i.e. profiles, which are adapted to the particular stroke (and speed of the stroke) desired for each piston as the piston moves about axis 11 at a constant speed. The runners can in fact be made in several sections to allow the adaptation of one or more parts of each roller to the kinematics required for the particular pistons and likewise to allow modifications thereof if desired.

Figure 4:
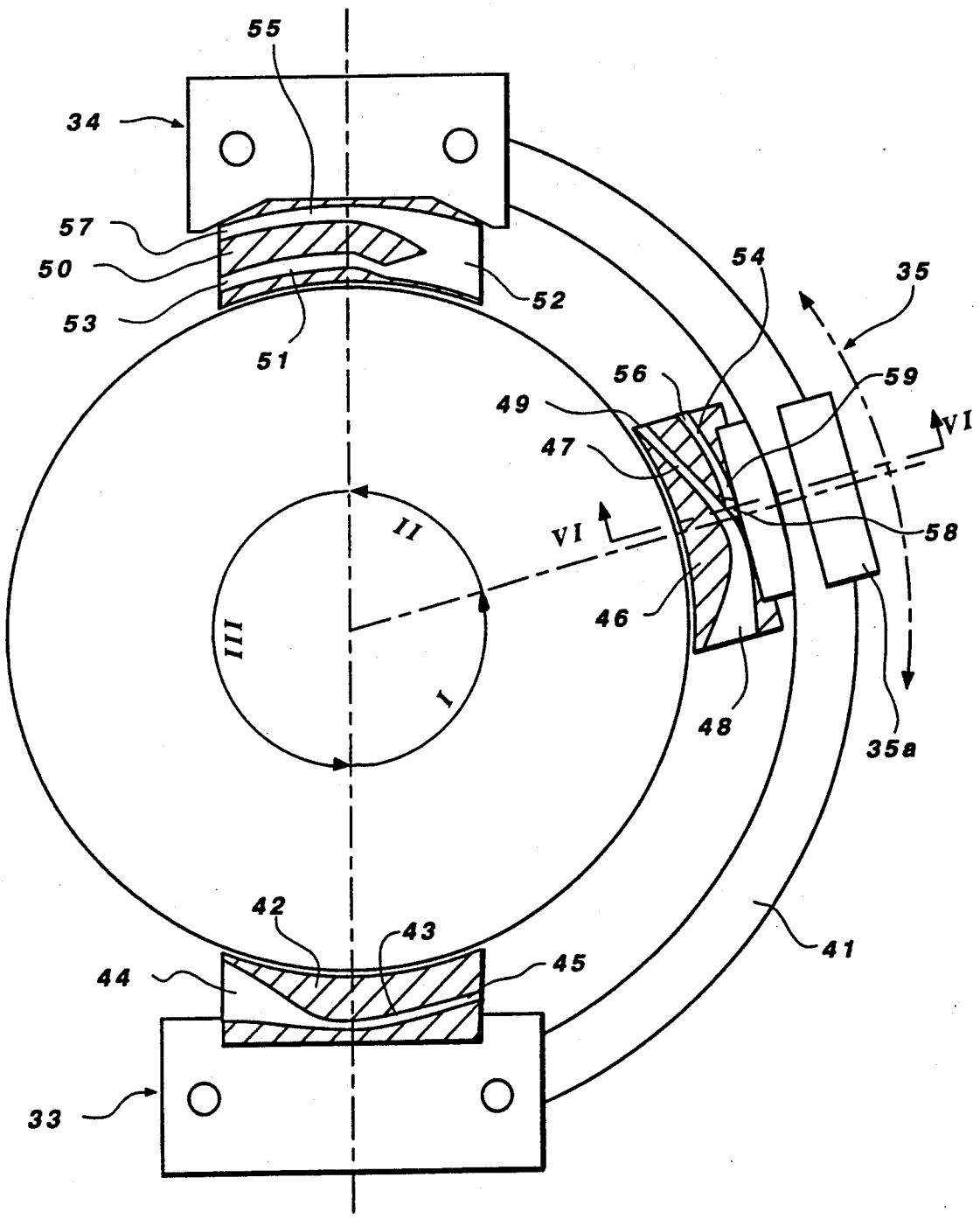
FIG. 4 is a top plan view of a portion of the circular support which includes camming structure by which a cam follower of a control valve cams through various stages of operation of the apparatus.

FIG. 4 diagrammatically illustrates the camming units 33, 34 and 35 which control the rotational orientation of the control valve 16 by moving the cam follower 32 (FIG. 2) to predetermined circumferential orientations relative to measuring chamber 12 as chamber 12 rotates (moves) about axis 11 of the apparatus 10. Each of the camming units 33, 34 and 35 functions to reorient cam follower 32 (which in turn reorients control valve 16 and the openings 19 and 22 therein) from one phase of operation to the next phase thereof as the particular measuring chamber 12 passes through each camming unit during a complete cycle of rotation about axis 11 of the apparatus 10.

Cam follower 32 is rigidly attached by means of lever 31 to the bottom 16*a* of the control valve 16. Therefore the follower 32 is allowed to move only in a circumferential direction around the longitudinal axis of the measuring chamber 12. Each camming unit causes the follower 32 to be oriented at a predetermined circumferential position corresponding to a particular alignment of valve openings 19 and 22 with conduits 18, 20 or 21 and thus a particular phase of the measuring and delivering process.

Camming units 33 and 34 are fixedly attached to a nonrotating portion of the apparatus 10 such as support arc 41. Camming unit 35, which is adjustable, is also attached to a nonrotating portion of apparatus 10 such as the support arc 41. However, it is attached, for example by a clamp 35*a* which can be tightened and untightened, so as to be slidably positionable at any point between fixed camming units 33 and 34 while remaining at a constant radial distance from axis 11.

Fixed camming units 33 and 34 function in the manner well known in conventional prior art canning apparatus of the present type. Fixed camming unit 33 includes a cam plate 42 in which a cam channel 43 is formed. The cam plate 42 is located such that it lies directly beneath the path of movement of the measuring chamber 12, such that cam channel 43 can accept follower 32 therein.

The cam channel 43 is enlarged, or widened, at its entrance opening 44 so that follower 32, regardless of its orientation beneath measuring chamber 12, will be picked up by the camming channel entrance when the particular measuring chamber 12 passes thereover. As the measuring chamber 12 continues to pass over cam plate 42, the follower 32 is forced into a position relative to the measuring chamber 12 which corresponds to the first phase of the process cycle. An exit opening 45 of cam channel 43 is narrowed to a width approximately equal to the diameter of follower 32 so that as follower 32 leaves cam plate 42, it is precisely located in its proper orientation corresponding to the first phase of the process cycle. This first phase of the process cycle is also the first stage of filling of the measuring chamber 12. As seen in FIG. 1, referring specifically to the topmost measuring chamber 12 in the drawing, the control valve 16 is caused to be rotated such that valve opening 19 aligns with the viscous material conduit 18.

Referring again to FIG. 4, adjustable camming unit 35 includes a cam plate 46 into which a cam channel 47 has been formed. Cam channel 47 includes an entrance 48 which is of sufficient width to entrap follower 32 regardless of its relative orientation with respect to measuring chamber 12, and an exit opening 49 which is of a width substantially equal to the diameter of the follower 32. As can be seen, the cam channel 47 causes the follower 32 to be adjusted to a new circumferential position relative to measuring chamber 12 as it passes over the camming unit 35. The position of follower 32 as it passes from the exit opening 49 corresponds to the second phase of the processing cycle which is also the second filling stage. As best seen in FIG. 1, measuring chamber 12′ shows the control valve 16′ in its orientation corresponding to the position of follower 32 after passing through cam channel 47. As can be seen, in this position valve opening 22′ is aligned with the liquid material conduit 21′.

Referring again to FIG. 4, the fixed camming unit 34 includes a camming plate 50 which has a cam channel 51 formed therein. Channel 51 has an entrance opening 52 formed therein which is of a sufficient width to trap the follower 32 therein regardless of the relative circumferential orientation of follower 32 with respect to the measuring chamber 12 as it passes thereover. Further, channel 51 includes an exit opening 53 which is of a width approximately equal to the diameter of follower 32.

When the measuring chamber 12 passes over cam plate 50, follower 32 is moved into cam channel 51 and reoriented in its circumferential position relative to measuring chamber 12. When follower 32 passes from exit opening 53, it is oriented in a position corresponding to the third phase of the process cycle which corresponds to the delivery stage. As shown in FIG. 1, measuring chamber 12″ shows the control valve 16″ in its orientation corresponding to the orientation of follower 32 as it leaves exit opening 53 of cam plate 50. In this orientation, the valve opening 19″ is aligned with delivery conduit 20″.

Again referring to FIG. 4, there is shown a secondary cam channel 54 which is formed in cam plate 46 of the adjustable camming unit 35, and also a secondary cam channel 55 located in cam plate 50 of the fixed camming unit 34. Cam channels 54 and 55 include exit opening 56 and 57 respectively. Adjustable camming unit 35 includes a mobile cam element 58 which locks closed an entrance opening 59 of the secondary channel 54 during normal operating conditions of the apparatus 10. However, should the apparatus 10 fail to be provided with cans to be filled thereby (or more specifically should the apparatus 10 sense that there is no can properly positioned below delivery nozzle 24) the mobile can element 58, moves to unlock the entrance opening 59 of channel 54. Due to the shape of the entrance opening 48, the follower 32, when passing therein, will automatically be directed into channel 54 unless mobile cam element 58 is in position to block the entrance 59 thereof.

If follower 32 has passed through the adjustable camming unit 35 by exiting through exit opening 56 (instead of exiting through exit opening 49), its subsequent orientation as it passes into entrance opening 52 of the fixed camming unit 34 causes it to pass into cam channel 55 and out of exit opening 57 thereof. It should be noted that the radial distance from the axis 11 to the exit opening 57 is equal to the radial distance from the axis 11 to the exit opening 45 of fixed camming unit 33, and equal to the radial distance from axis 11 to the exit opening 56 of adjustable camming unit 35. Further, cam channel 55, cam channel 43, and cam channel 54 are all arcuate in shape with each arc thereof lying on the circumference of an imaginary circle having its center at axis 11. It is evident therefore that follower 32, once orientated in its position dictated by its passage through cam channel 43 and exit opening 45 thereof, will not be reoriented by adjustable camming unit 35 or fixed camming unit 34 if the apparatus 10 senses that no can is present at the delivery nozzle and therefore causes mobile cam element 58 to move out of its locking position of opening 59. Thus, due to the apparatus 10 sensing that no cans are present to receive delivery from delivery nozzle 24, control valve 16 remains stationary throughout the entire process cycle (in fact the control valve 16 remains stationary through any number of process cycles it is caused to execute) due to the fact that mobile cam element 58 no longer blocks entrance opening 59.

It is to be understood that the means in which apparatus 10 senses that a can is not present under the delivery nozzle 24 is the same type of sensing means used in the well known prior art apparatus of this type.

Figure 5:
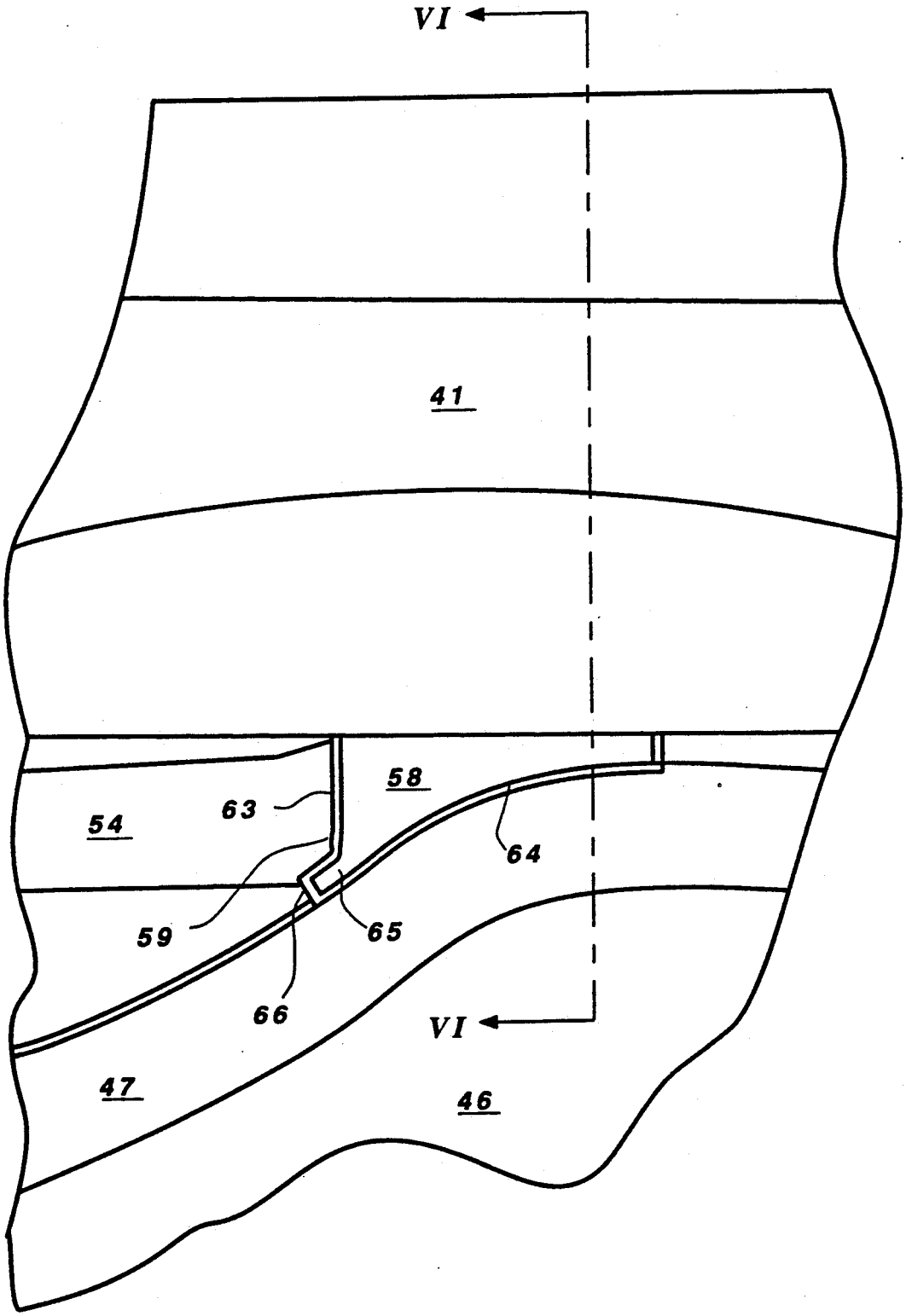
FIG. 5 is an enlarged, fragmented view of an adjustable position camming structure by which the cam follower of the control valve is cammed from the first stage to the second stage of a product measurement operation.
Figure 6:
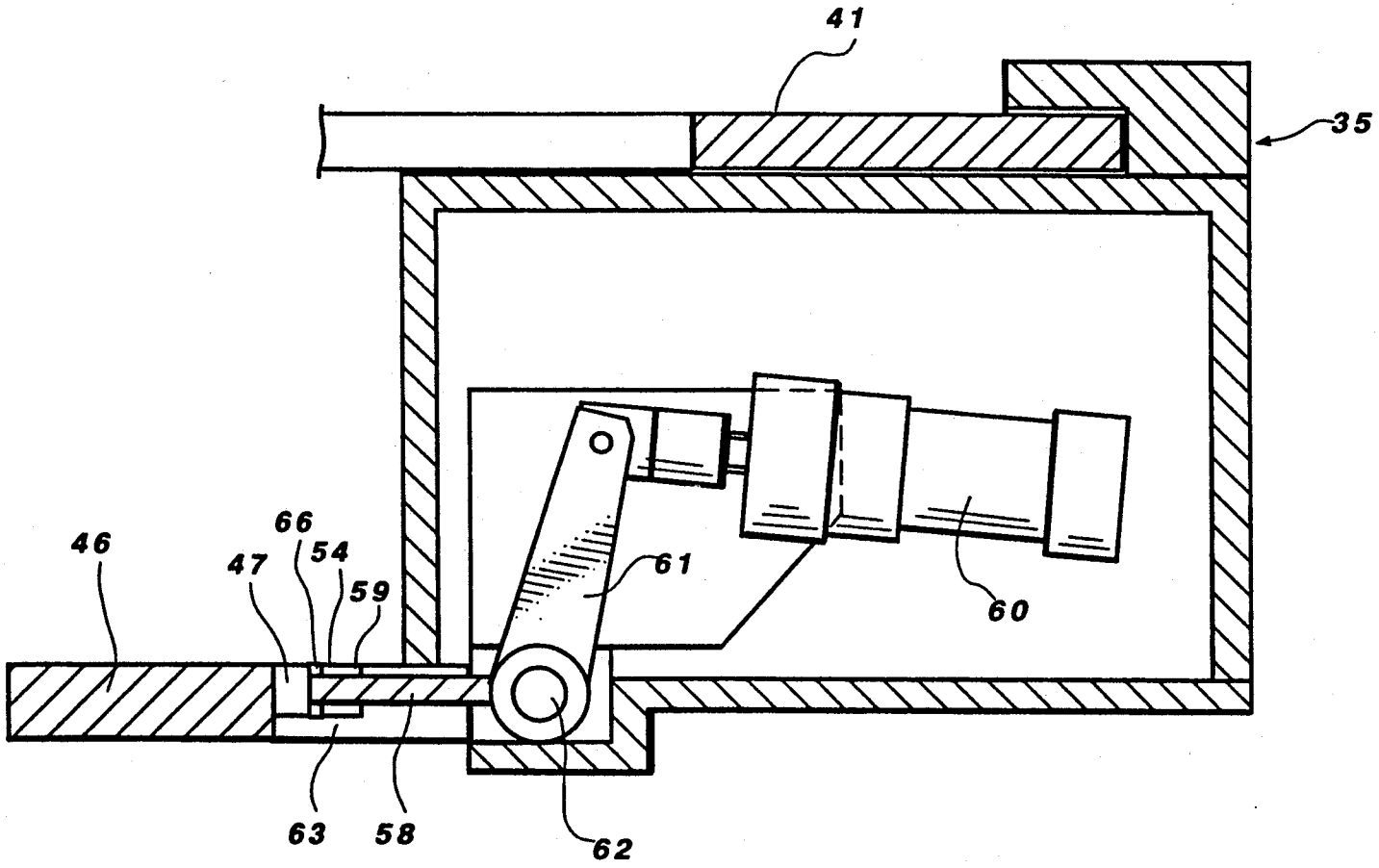
FIG. 6 is a cross-sectional view of the structure of FIG. 5 taken along lines VI—VI of FIG. 5.

As shown in FIGS. 5 and FIG. 6, a driving cylinder 60 (FIG. 6) is shown for driving the mobile camming element 58; this cylinder may be of the hydraulic or pneumatic type. The cylinder 60 is attached to a lever arm 61 which is attached to the mobile cam element 58. Lever arm 61 is fixed for rotational movement about pin 62.

In operation, mobile cam element 58 is located in its "up" position as is shown in FIG. 6 during normal operation of the apparatus 10. However, should the apparatus 10 sense that no cans are located therein, it signals the driving cylinder 60 which causes lever arm 61 to rotate about pin 62 resulting in mobile cam element 58 lowering into a recess 63 until it no longer blocks opening 59 of channel 54.

Mobile camming element 58 includes a smoothly curving, generally arcuately shaped surface 64 which corresponds to the shape of channel 47 (FIG. 5), and an extension 65 which is intended to match with abutment 66 of the cam plate 46 when the mobile cam element 58 is in its "up" position.

The operation of apparatus 10 of the drawings will now be further described.

The operator first adjusts the location of adjustable camming unit 35 along the support arc 41 (see FIG. 4) to a position which corresponds to the proper ratio of viscous and fluid materials which are to be drawn into the measuring chamber 12. It should be noted that movement of adjustable camming unit 35 toward the fixed camming unit 33 causes phase one of the cycling process (which corresponds to the first filling stage thereof) to be completed within a smaller portion of the entire cycle so that less viscous material is supplied to the measuring chamber 12. Alternatively, movement of adjustable camming unit 35 toward the fixed camming unit 34 causes the second phase of the process cycle to be shortened so that less liquid material is supplied to the measuring chamber.

At the end of a process cycle, the chamber piston 15, nozzle piston 26, and control valve 16 are all positioned as shown in FIG. 2. The first phase of the processing cycle begins as measuring chamber 12 passes over fixed camming unit 33. Follower 32, and thus control valve 16, are reoriented by the fixed camming unit 33 to a position corresponding to the measuring chamber 12 as shown in FIG. 1 (topmost chamber in drawing). As the chamber 12 continues to rotate about axis 11, the chamber piston 15 is forced upward by the action of roller 37 (FIG. 3) and the upward slope of runner **39*b*. This piston motion causes viscous or dry material located in viscous material product supply tank 14 to pass through conduit 18, through valve opening 19 into measuring chamber 12 (FIG. 1**).

Depending on the positioning of the adjustable camming unit 35, chamber piston 15 has traveled upwardly a predetermined amount of its total upward movement to thus fill chamber 12 a certain amount with the viscous material prior to chamber 12 passing over the adjustable camming unit 35. If the apparatus 10 senses that cans are properly positioned therein, the mobile cam element 58 remains in its "up" position and the follower 32 enters entrance 48 and is forced by arcuate surface 64 of the mobile cam element 58 into the cam channel 47 (FIG. 5). The movement of follower 32 causes the rotation of the control valve 16 to the orientation shown by measuring chamber 12' of FIG. 1. In this position, valve opening 22' is aligned with conduit 21' thus allowing liquid material to pass from the liquid material supply tank 23 (as shown in FIG. 3) into the measuring chamber 12'. As is also evident, valve opening 19' is now partially aligned with delivery conduit 20'. However, due to the previous process cycle, delivery conduit 20 is generally filled with product remaining undelivered from the previous cycle and therefore has no effect of the measuring on the present cycle.

Chamber piston 15 continues its upward motion to draw liquid into measuring chamber 12 until the chamber 12 passes over the fixed camming unit 34. At this point, follower 32 passes through entrance 52 and is routed into cam channel 51 (FIG. 4) which causes it to again be reoriented relative to the measuring chamber 12. The reorientation of the follower 32 causes the reorientation of control valve 16'' to the position shown in measuring chamber 12'' of FIG. 1. Also, when the chamber 12'' passes over the fixed camming unit 34, the chamber piston 15 has arrived at its highest position and is now forced downward by the contact of roller 37 (FIG. 3) with the runner **39*a*. Further, at this point, the nozzle piston 26 has been lifted by the contact of roller 38 with runner 40*b* to its highest position in preparation for the third phase of the process cycle which is also the delivery stage thereof. As the chamber 12'' continues its rotation about axis 11 through the process cycle, the chamber piston 15 is forced downwardly by runner 39*a* contacting roller 37 and causes the product located in the chamber 12'' to pass through valve opening 19'' into delivery conduit 20'' and from there into delivery nozzle 24. The chamber piston 15 proceeds to the bottom of measuring chamber 12'' and subsequently the nozzle piston 26 is forced downwardly by the contact of roller 38 with runner 40*a* to push the product out of the nozzle opening 24*a* (FIG. 2) into the can positioned immediately therebelow. The orientation of the pistons 15 and 26 and the control valve 16 are once again arranged in their end of cycle position as shown in FIG. 2**.

As can be seen, a volume of product is again trapped in delivery conduit 20, this amount of product being equal to the amount of product which was trapped in the previous cycle therefore negating its effect on measurement versus delivery of product.

In the instance where apparatus 10 senses that no cans are properly positioned under delivery nozzle 24, the control valve 16 remains with its valve opening 19 aligned with product delivery conduit 18 (as shown in FIG. 1 with reference to measuring chamber 12). The effect is that chamber piston 15 draws viscous material into the measuring chamber 12 at the beginning of the cycle (during the normal phases one and two thereof), but then immediately returns the product directly back into conduit 18 during the end of the cycle (during phase three). Therefore, although the chamber piston 15 (and also the nozzle piston 26) functions in an identical manner whether or not a can is sensed, the failure of control valve 16 to rotate effectively prevents delivery of any product through the opening **24*a* of the delivery nozzle 24**.

It is to be understood that the above described embodiment of the present invention is only illustrative of the application of the principles thereof. Numerous modifications and alternative arrangements may be devised by those skilled in the art without departing from the spirit and scope of the present invention and the appended claims are intended to cover such modifications and arrangements. For example, the locations of chamber skirt 27 openings 28, 29 and 30 could be rearranged such as by positioning opening 30 between openings 28 and 29. With this configuration, a single valve opening, such as opening 19, would be sufficient to receive product into the chamber 12 and discharge it therefrom.

What is claimed is:

1. Apparatus for filling cans with two constituent products comprising a first supply tank for holding a first constitute product for canning, a second supply tank for holding a second constituent product for canning, a rotatable support, a tubular enclosure mounted on the support to rotate with the support, said enclosure having an upper end and lower end, a first piston disposed within said tubular enclosure to selectively reciprocate therein, a first supply conduit communicating said lower portion of said enclosure with said first supply tank for supplying the first constituent product to said enclosure, a second supply conduit communicating said lower portion of said enclosure with said second supply tank for supplying the second constituent product to said enclosure, a filling nozzle, a second piston disposed within said filling nozzle to selectively reciprocate therein, a delivery conduit communicating said lower portion of said enclosure with said nozzle for delivery of the first and second constituent products to said nozzle, and valve means for controlling communication between said first and second supply conduits and said delivery conduit with said enclosure.

2. The apparatus of claim 1, wherein said valve means is movably disposed to prevent simultaneous communication of said first and second supply conduits with said enclosure.

3. The apparatus of claim 2, wherein said valve means comprises a rotatable hollow cylinder disposed in the enclosure and having at least one opening in the sidewall thereof, said cylinder being rotatable to enable selective and exclusive communication between the opening and the first supply conduit, and between the opening and the second supply conduit.

4. The apparatus of claim 3 further including means for rotating the support, and means for controlling the rotational position of said cylinder relative to said enclosure as the support rotates.

5. The apparatus of claim 4 wherein said controlling means includes an adjustable controlling unit and first and second fixed controlling units disposed about the axis of rotation of said support generally adjacent the pathway of movement of the valve means, each for controlling rotation of said cylinder as the valve means moves past the location of said each unit.

6. The apparatus of claim 5 wherein said adjustable controlling unit includes means for adjusting the position of the adjustable controlling unit adjacent said pathway relative to the positions of said first and second controlling units.

7. The apparatus of claim 6 wherein said first and second fixed controlling units and said adjustable controlling unit each include a substantially flat horizontally oriented cam plate having at least one cam channel formed therein, and wherein said valve means includes a cam follower means coupled to said cylinder for traveling through said cam channels as said support rotates so that the cam channels control the position of the cam follower to thereby control the rotational position of the cylinder.

8. The apparatus of claim 7 wherein said cam channels are formed in said cam plates such that movement of said cam follower therethrough causes rotation of said cylinder with respect to said enclosure.

9. The apparatus of claim 8 wherein the cam plate of said adjustable controlling unit includes an additional cam channel having an opening which leads from the other cam channel of the plate to the additional cam channel, and a gate element moveable between a first position, in which said follower is prevented from traveling from the other cam channel to the additional cam channel, and a second position, in which said follower is guided from the other cam channel to the additional cam channel, said apparatus including means for selectively moving the gate element between the first and second positions, wherein said follower causes rotation of the cylinder when the follower travels through the other channel but does not cause rotation when it travels through the additional channel.

10. The apparatus of claim 1 further comprising a first roller operatively connected to said first piston and a second roller operatively connected to said second piston, and further comprising a first runner disposed adjacent the first roller and a second runner disposed adjacent the second roller, both runners circumscribing the axis of rotation of said rotatable support, each runner being angled to guide its respective adjacent roller, and thus the piston to which the roller is connected, up and down as desired during rotation of said rotatable support.

* * * * *